US011959638B2

(12) United States Patent
Zhang et al.

(10) Patent No.: US 11,959,638 B2
(45) Date of Patent: Apr. 16, 2024

(54) BOILER

(71) Applicant: IHI Corporation, Tokyo (JP)

(72) Inventors: Juwei Zhang, Tokyo (JP); Takamasa Ito, Tokyo (JP); Sakiko Ishihara, Tokyo (JP)

(73) Assignee: IHI Corporation, Tokyo (JP)

( * ) Notice: Subject to any disclaimer, the term of this patent is extended or adjusted under 35 U.S.C. 154(b) by 486 days.

(21) Appl. No.: 17/155,355

(22) Filed: Jan. 22, 2021

(65) Prior Publication Data

US 2021/0140629 A1 May 13, 2021

Related U.S. Application Data

(63) Continuation of application No. PCT/JP2019/035619, filed on Sep. 11, 2019.

(30) Foreign Application Priority Data

Sep. 11, 2018 (JP) ..... 2018-169588

(51) Int. Cl.
*F23J 7/00* (2006.01)
*F22B 37/00* (2006.01)
*F23C 1/00* (2006.01)

(52) U.S. Cl.
CPC ..... *F23J 7/00* (2013.01); *F22B 37/008* (2013.01); *F23C 1/00* (2013.01); *F23C 2900/06041* (2013.01)

(58) Field of Classification Search
CPC ..... F23J 7/00; F22B 37/008; F23C 1/00
See application file for complete search history.

(56) References Cited

U.S. PATENT DOCUMENTS 4,335,084 A * 6/1982 Brogan ..... B01D 53/56 110/345
4,940,006 A 7/1990 Temelli
5,681,158 A * 10/1997 Knapp ..... F23L 7/00 431/5
5,756,059 A * 5/1998 Zamansky ..... F23J 7/00 423/239.1
5,820,838 A * 10/1998 Tsuo ..... B01D 53/56 423/235
6,453,830 B1 * 9/2002 Zauderer ..... F23D 1/005 110/348
6,973,883 B1 * 12/2005 Annamalai ..... F23D 17/005 110/345
2004/0067460 A1 * 4/2004 Monro ..... F23L 7/00 431/9

(Continued)

FOREIGN PATENT DOCUMENTS

CN 107543148 A 1/2018
CN 107559858 A 1/2018

(Continued)

*Primary Examiner* — David J Laux
(74) *Attorney, Agent, or Firm* — Oblon, McClelland, Maier & Neustadt, L.L.P.

(57) ABSTRACT

A boiler performs mixed-fuel combustion of a sulfur-containing fuel and ammonia as a fuel, and includes a furnace having a plurality of wall parts, a burner installed on at least one of the wall parts of the furnace, and an ammonia injection port that is configured to cause the ammonia to be burned as the fuel to flow along an inner wall surface of the wall part where the burner is not installed.

5 Claims, 3 Drawing Sheets

(56) References Cited

U.S. PATENT DOCUMENTS

| | | | | |
|---|---|---|---|---|
| 2004/0185402 | A1* | 9/2004 | Moberg | F23C 5/32 431/9 |
| 2010/0203461 | A1* | 8/2010 | Maly | F23C 6/045 431/9 |
| 2011/0142739 | A1* | 6/2011 | Swanson | B01D 53/56 423/235 |
| 2013/0142719 | A1 | 6/2013 | Kai et al. | |
| 2015/0241058 | A1 | 8/2015 | Mine et al. | |
| 2017/0114999 | A1* | 4/2017 | Giraud | F27B 9/10 |
| 2020/0003420 | A1 | 1/2020 | Ito et al. | |

FOREIGN PATENT DOCUMENTS

| | | | |
|---|---|---|---|
| EP | 2 862 621 | A1 | 4/2015 |
| JP | 7-310903 | A | 11/1995 |
| JP | 2012-35216 | A | 2/2012 |
| JP | 2014-522 | A | 1/2014 |
| JP | 2014-55759 | A | 3/2014 |
| JP | 2016-32391 | A | 3/2016 |
| JP | 6296216 | B1 | 3/2018 |
| JP | 6332578 | B1 | 5/2018 |
| JP | 2018-138863 | A | 9/2018 |
| JP | 2018-162724 | A | 10/2018 |
| JP | 2018-173177 | A | 11/2018 |
| JP | 2018-200144 | A | 12/2018 |
| JP | 2019-086188 | A | 6/2019 |
| JP | 2019-86189 | A | 6/2019 |
| JP | 2019-86191 | A | 6/2019 |
| WO | WO 2012/020557 | A1 | 2/2012 |
| WO | WO 2013/191053 | A1 | 12/2013 |

* cited by examiner

BOILER

CROSS-REFERENCE TO RELATED APPLICATIONS

This application is a Continuation Application based on International Application No. PCT/JP2019/035619, filed on Sep. 11, 2019, which claims priority on Japanese Patent Application No. 2018-169588, filed Sep. 11, 2018, the contents of which are incorporated herein by reference.

TECHNICAL FIELD

The present disclosure relates to a boiler.

BACKGROUND

Patent Document 1 below discloses a complex energy system that burns a fuel containing ammonia. In order to reduce a discharge amount of carbon dioxide, the complex energy system adds ammonia to natural gas serving as a main fuel and burns the fuel containing ammonia.

DOCUMENT OF RELATED ART

Patent Document

[Patent Document 1] Japanese Unexamined Patent Application, First Publication No. 2016-032391

SUMMARY

When a substance containing a sulfur component such as natural gas or pulverized coal is burned as a fuel, corrosive hydrogen sulfide ($H_2S$) is generated. When a furnace is exposed to the generated hydrogen sulfide for a long period of time, corrosion of the furnace gradually progresses, and accordingly it is necessary to carry out regular maintenance work for a boiler. In particular, in a case of adopting a two-stage combustion method in which an unburned fuel is re-burned in an upper part of the furnace, as a reduction region having a high fuel concentration is formed in a main combustion region in a central part of the furnace and a large amount of hydrogen sulfide is generated in the main combustion region, the corrosion may progress.

The present disclosure is made in view of the above-described problems, and an object thereof is to suppress corrosion of a wall part of a furnace due to hydrogen sulfide in a boiler which perform mixed-fuel combustion of a fuel containing a sulfur component and an ammonia fuel.

An aspect of the present disclosure is a boiler which performs mixed-fuel combustion of a sulfur-containing fuel and ammonia as a fuel, and includes a furnace having a plurality of wall parts, a burner installed on at least one of the wall parts of the furnace, and an ammonia injection port that is configured to cause the ammonia to be burned as the fuel to flow along an inner wall surface of the wall part where the burner is not installed.

In the boiler according to the above-described aspect, the wall parts of the furnace may include a front wall on which the burner is installed, a rear wall on which the burner is installed, and which is disposed to face the front wall, and a side wall which connects the front wall and the rear wall to each other, and on which the burner is not installed, and the ammonia injection port may be provided on at least one of the front wall and the rear wall, and disposed closer to the side wall than the burner in a horizontal direction.

In the boiler according to the above-described aspect, the ammonia injection port may be configured to inject the ammonia in a direction in which the burner injects the fuel.

In the boiler according to the above-described aspect, the ammonia injection port may be further installed on the side wall.

In the boiler according to the above-described aspect, the wall parts of the furnace may include a hopper wall narrowed toward a discharge port through which ash is discharged outward, and the ammonia injection port may be configured to cause the ammonia to flow along an inner wall surface of the hopper wall.

According to the present disclosure, a portion of the ammonia to be burned as a fuel flows from the ammonia injection port along the inner wall surface of the wall part where the burner is not installed. Since the inner wall surface of the wall part where the burner is installed is maintained in a high oxygen concentration state by combustion air injected from the burner and a high reduction region is less likely to be formed thereon, the hydrogen sulfide concentration of this inner wall surface is relatively low, and this inner wall surface is less likely to be corroded. On the other hand, since the oxygen concentration of the inner wall surface of the wall part where the burner is not installed is relatively low and the hydrogen sulfide concentration thereof is relatively high, this inner wall is likely to be corroded. According to the present disclosure, the ammonia injected from the ammonia injection port is burned in the vicinity of the inner wall surface of the wall part where the burner is not installed, and many OH radicals are generated in the vicinity of this inner wall surface. As a result, an oxidation reaction of hydrogen sulfide is promoted in the vicinity of the inner wall surface of the wall part where the burner is not installed, and thus it is possible to suppress corrosion of this wall part due to the hydrogen sulfide. Therefore, according to the present disclosure, it is possible to suppress corrosion of the wall part of the furnace due to the hydrogen sulfide in the boiler which performs mixed-fuel combustion of a fuel containing a sulfur component and an ammonia fuel.

DESCRIPTION OF EMBODIMENTS

Hereinafter, an embodiment of a boiler according to the present disclosure will be described with reference to the drawings.

First Embodiment

Figure 1:
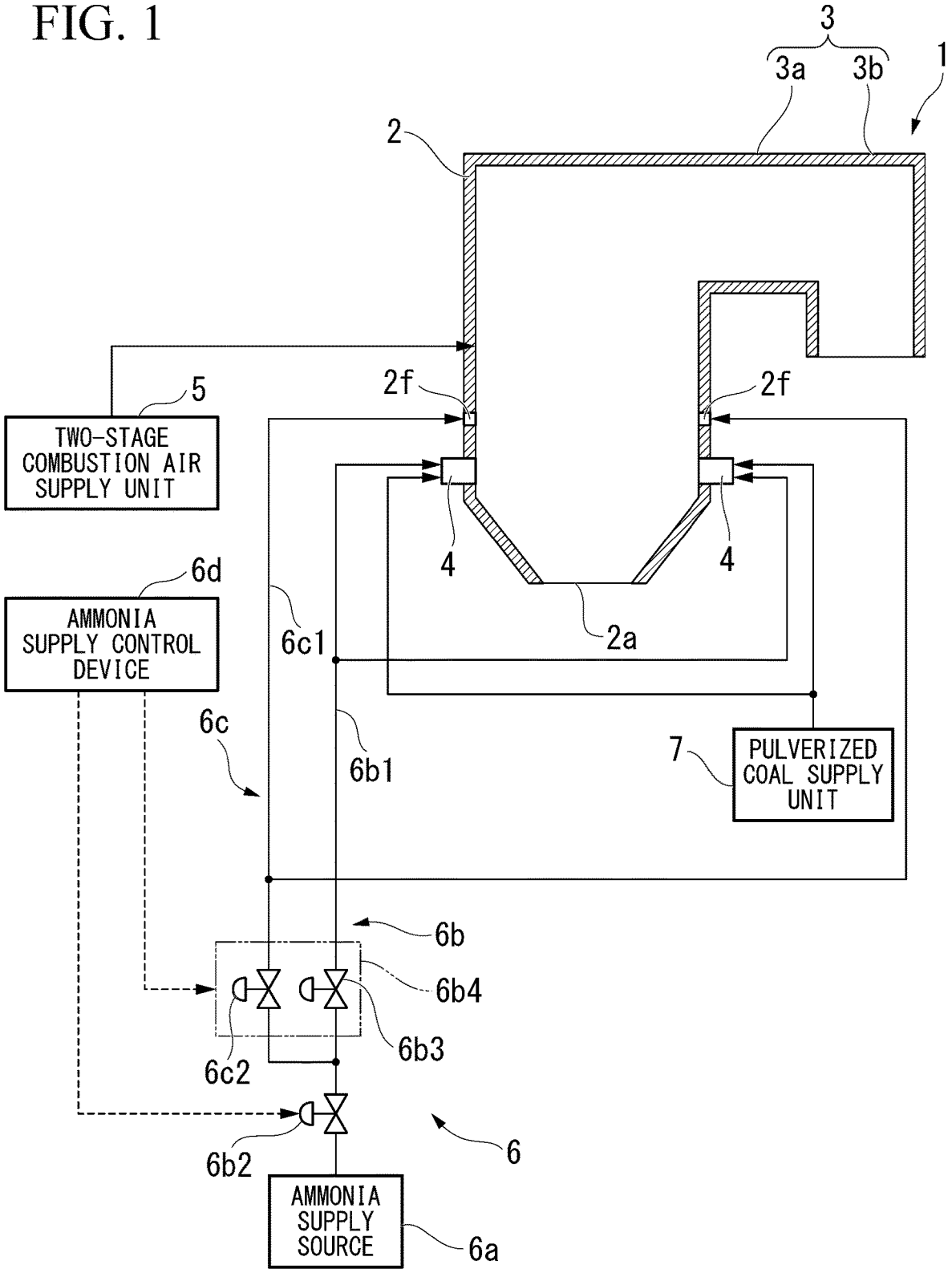
FIG. 1 is a schematic diagram showing a main part configuration of a boiler according to a first embodiment of the present disclosure.

FIG. 1 is a schematic diagram showing a main part configuration of a boiler 1 of a first embodiment. As illustrated in FIG. 1, the boiler 1 includes a furnace 2, a flue 3, burners 4, a two-stage combustion air supply unit 5, an ammonia supply unit 6, and a pulverized coal supply unit 7.

The furnace 2 is a furnace body configured to include a vertically and cylindrically provided furnace wall, and to burn a fuel such as ammonia and pulverized coal to generate combustion heat. In the furnace 2, high-temperature combustion gas is generated by burning the fuel. In addition, a bottom part of the furnace 2 is provided with a discharge port 2*a* through which ash generated by burning the fuel is discharged outward.

Figure 2:
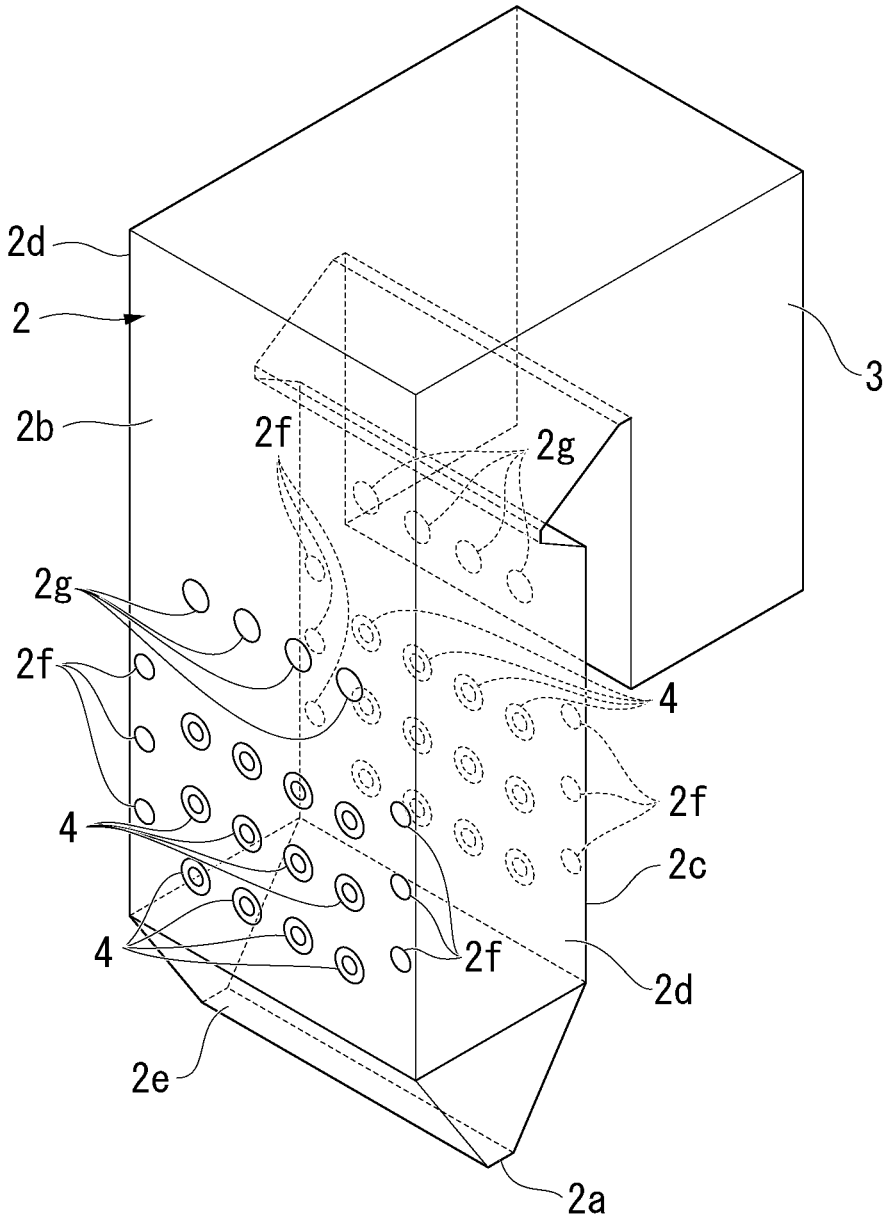
FIG. 2 is a schematic perspective view including a furnace for showing a disposition of a burner and an ammonia injection port which are included in the boiler according to the first embodiment of the present disclosure.

FIG. 2 is a schematic perspective view including the furnace 2 for showing a disposition of the burners 4 and ammonia injection ports 2*f* (to be described later). In FIG. 2, a double circle indicates a disposed position of the burner 4, and a small single circle indicates a disposed position of the ammonia injection port 2*f* (to be described later). In addition, a large single circle indicates a disposed position of a two-stage combustion air port 2*g* (to be described later).

As illustrated in FIG. 2, in the present embodiment, the furnace 2 has a hollow shape having a rectangular shape in a plan view, and has a front wall 2*b*, a rear wall 2*c*, side walls 2*d*, and a hopper wall 2*e* as wall parts. The front wall 2*b* is a wall part disposed on a front side of the furnace 2. The rear wall 2*c* is a wall part disposed on a rear side of the furnace 2, and is disposed to face the front wall 2*b*. The side wall 2*d* is a wall part that connects the front wall 2*b* and the rear wall 2*c* to each other. In the present embodiment, two side walls 2*d* are provided such that one side wall 2*d* connects one end of the front wall 2*b* in a horizontal direction and one end of the rear wall 2*c* in the horizontal direction to each other, and the other side wall 2*d* connects the other end of the front wall 2*b* in the horizontal direction and the other end of the rear wall 2*c* in the horizontal direction to each other. The hopper wall 2*e* includes inclined walls narrowed toward the discharge port 2*a*, and forms the bottom part of the furnace 2.

Among the wall parts included in the furnace 2, the front wall 2*b* and the rear wall 2*c* are wall parts where the burners 4 are installed. Among the wall parts included in the furnace 2, the side walls 2*d* and the hopper wall 2*e* are wall parts where the burner 4 is not installed. In the boiler 1 of the present embodiment, a plurality of ammonia injection ports 2*f* that inject the ammonia supplied from the ammonia supply unit 6 toward the inside of the furnace 2 are provided on the front wall 2*b* and the rear wall 2*c* which are the wall parts where the burners 4 are installed.

As illustrated in FIG. 2, the ammonia injection ports 2*f* provided on the front wall 2*b* are disposed closer to the side wall 2*d* than the burners 4 provided on the front wall 2*b*. That is, when viewed from one side wall 2*d*, the ammonia injection port 2*f* closest to the side wall 2*d* is disposed closer to the side wall 2*d* than the burner 4 closest to the side wall 2*d*. The ammonia injection port 2*f* injects the ammonia in an injection direction of the fuel injected from the burner 4, and causes the ammonia to flow along the inner wall surface of the side wall 2*d*. The ammonia injected from the ammonia injection port 2*f* is a portion of the ammonia to be originally supplied to the burner 4 as a fuel, and after being injected into the furnace 2, the ammonia is burned inside the furnace 2. As described above, in the boiler 1 of the present embodiment, the ammonia to be burned as a fuel is injected from the ammonia injection port 2*f* along the inner wall surface of the side wall 2*d* where the burner 4 is not provided.

Although the ammonia injection port 2*f* is illustrated in FIG. 1 to conceptually indicate that the ammonia injection port 2*f* is provided in the furnace 2, a position of the ammonia injection port 2*f* in FIG. 1 does not indicate a position where the ammonia injection port 2*f* is actually provided. Actually, as illustrated in FIG. 2, the ammonia injection port 2*f* is disposed between the burner 4 and the side wall 2*d* in the horizontal direction.

Referring back to FIG. 1, the flue 3 is connected to the upper part of the furnace 2, and guides the combustion gas generated in the furnace 2 to the outside as exhaust gas. The flue 3 includes a horizontal flue 3*a* extending horizontally from the upper part of the furnace 2, and a rear flue 3*b* extending downward from an end portion of the horizontal flue 3*a*.

Although omitted in FIG. 1, the boiler 1 includes a superheater installed in the upper part or the like of the furnace 2. The superheater generates steam by exchanging heat between the combustion heat generated in the furnace 2 and water. In addition, although omitted in FIG. 1, the boiler 1 may include a reheater, a fuel economizer, and an air preheater.

The burners 4 are disposed on the wall parts in the lower part of the furnace 2. A plurality of the burners 4 are installed in a circumferential direction of the furnace 2. In addition, although omitted in FIG. 1, a plurality of the burners 4 are also installed in a height direction of the furnace 2. The burners 4 are two-dimensionally disposed in the lower part of the furnace 2 and are disposed to face each other, and inject and burn the fuel. All of the burners 4 are composite burners that can inject the ammonia and the pulverized coal as a fuel into the furnace 2. Although omitted in FIG. 1, the furnace 2 is provided with an ignition device for igniting the fuel (ammonia and pulverized coal) injected into the furnace 2 from the burner 4. In addition, although omitted in FIG. 1, the boiler 1 has a combustion air supply unit that supplies combustion air to the burners 4. The fuel (ammonia and pulverized coal) injected from each of the burners 4 into the furnace 2 together with the combustion air is ignited and burned by an operation of the ignition device.

All of the burners 4 installed in the boiler 1 may not necessarily be the composite burners as described above. For example, a configuration including a coal single-fuel combustion burner may be adopted. However, the boiler 1 of the present embodiment is provided with at least one burner 4 that can burn the ammonia as a fuel such that the boiler 1 can perform mixed-fuel combustion of the ammonia and the pulverized coal inside the furnace 2.

Here, ammonia ($NH_3$) is a compound of hydrogen (H) and nitrogen (N) as expressed by a molecular formula, and does not contain carbon (C) as a constituent atom. In addition, the ammonia (low carbon fuel) is known as a flame-retardant substance, and is a hydrogen carrier substance having three hydrogen atoms as in methane ($CH_3$). The pulverized coal is obtained by crushing coal which is a fossil fuel to a size of approximately several micrometers, and is generally used as a fuel for the boiler. That is, the ammonia is a low carbon fuel having a lower carbon concentration than the pulverized coal (carbon fuel).

The two-stage combustion air supply unit 5 is connected to the furnace 2 above the burner 4, and supplies two-stage combustion air into the furnace 2. The two-stage combustion air is supplied by the two-stage combustion air supply unit 5, and an unburned portion of the fuel, which has not been burned by the burner 4, is burned by the two-stage combustion air. In this manner, heat collection performance of the boiler 1 can be improved, and the unburned portion of the fuel contained in the exhaust gas can be reduced.

The ammonia supply unit 6 includes an ammonia supply source 6*a*, a burner supply part 6*b*, a port supply part 6*c*, and an ammonia supply control device 6*d*. The ammonia supply source 6*a* includes a tank that stores the ammonia. The ammonia supply source 6*a* may not necessarily be a component of the ammonia supply unit 6. That is, the ammonia supply unit 6 may take in the ammonia from the ammonia supply source 6*a* installed outside.

The burner supply part 6*b* includes a burner supply pipe 6*b*1 that connects the ammonia supply source 6*a* and the burner 4 to each other, an overall flow rate adjustment valve 6*b*2 and a burner supply amount adjustment valve 6*b*3 which are installed in an intermediate part of the burner supply pipe 6*b*1. The burner supply pipe 6*b*1 guides a portion, which is to be supplied to the burner 4, of the ammonia supplied from the ammonia supply source 6*a*. The overall flow rate adjustment valve 6*b*2 controls an overall flow rate of the ammonia to be supplied from the ammonia supply source 6*a* to the burner supply pipe 6*b*1. The overall flow rate of the ammonia means a flow rate of the ammonia to be burned as a fuel. The burner supply amount adjustment valve 6*b*3 is disposed on the downstream side of the overall flow rate adjustment valve 6*b*2, and controls a flow rate of the ammonia to be supplied to the burner 4.

The port supply part 6*c* includes a port supply pipe 6*c*1 connected to the ammonia injection port 2*f* of the furnace 2, and a port supply amount adjustment valve 6*c*2 installed in an intermediate part of the port supply pipe 6*c*1. One end of the port supply pipe 6*c*1 is connected to the burner supply pipe 6*b*1 between the overall flow rate adjustment valve 6*b*2 and the burner supply amount adjustment valve 6*b*3. That is, the port supply pipe 6*c*1 connects the burner supply part 6*b* and the ammonia injection port 2*f* to each other, takes in a portion of the ammonia from the burner supply part 6*b*, and guides the portion of the ammonia to the ammonia injection port 2*f*. The port supply amount adjustment valve 6*c*2 controls a flow rate of the ammonia to be injected from the ammonia injection port 2*f*.

The ammonia supply control device 6*d* controls the overall flow rate adjustment valve 6*b*2, the burner supply amount adjustment valve 6*b*3, and the port supply amount adjustment valve 6*c*2 to adjust an opening degree of the overall flow rate adjustment valve 6*b*2, an opening degree of the burner supply amount adjustment valve 6*b*3, and an opening degree of the port supply amount adjustment valve 6*c*2. The ammonia supply control device 6*d* adjusts the opening degree of the overall flow rate adjustment valve 6*b*2, based on an external command or the like, thereby controlling the overall flow rate of the ammonia to be taken in from the ammonia supply source 6*a*.

In addition, distribution of the ammonia taken in from the ammonia supply source 6*a* to the burner 4 and the ammonia injection port 2*f* is determined by the opening degree of the burner supply amount adjustment valve 6*b*3 and the opening degree of the port supply amount adjustment valve 6*c*2. That is, the burner supply amount adjustment valve 6*b*3 and the port supply amount adjustment valve 6*c*2 form a mechanism (distribution adjustment mechanism 6*b*4) for adjusting a distribution ratio of the ammonia between the burner 4 and the ammonia injection port 2*f*. The ammonia supply control device 6*d* adjusts the distribution ratio of the ammonia to the burner 4 and the ammonia injection port 2*f* by controlling the distribution adjustment mechanism 6*b*4 including the burner supply amount adjustment valve 6*b*3 and the port supply amount adjustment valve 6*c*2.

The pulverized coal supply unit 7 is connected to the burner 4, crushes the coal into the pulverized coal, and supplies the pulverized coal to the burner 4. For example, the pulverized coal supply unit 7 includes a mill that crushes the coal to a particle size of approximately several micrometers to obtain the pulverized coal, and a coal feeder that supplies the pulverized coal produced by the mill to the burner 4. The pulverized coal supply unit 7 may be configured to supply the pulverized coal directly from the mill to the burner 4 without providing the coal feeder.

In the boiler 1 of the present embodiment, the ammonia is supplied from the ammonia supply unit 6 to the burner 4, and the pulverized coal is supplied from the pulverized coal supply unit 7 to the burner 4, thereby forming a flame by the burner 4 using the ammonia and the pulverized coal as a fuel. In addition, the two-stage combustion air is supplied into the furnace 2 by the two-stage combustion air supply unit 5, and the unburned fuel contained in the combustion gas is burned. The combustion gas generated by burning the fuel moves from the lower part to the upper part of the furnace 2, and is guided outward through the flue 3. In addition, in the boiler 1 of the present embodiment, the ammonia injected from the ammonia injection port 2*f* of the furnace 2 flows along the inner wall surface of the side wall 2*d*, and is burned in the vicinity of the inner wall surface of the side wall 2*d*.

In the boiler 1 of the present embodiment, the inner wall surfaces of the front wall 2*b* and the rear wall 2*c* where the burners 4 are installed are maintained in a high oxygen concentration state by the combustion air injected from the burner 4, and a high reduction region is less likely to be formed thereon. Therefore, the hydrogen sulfide concentration in the vicinity of the inner wall surfaces of the front wall 2*b* and the rear wall 2*c* is relatively lower than the hydrogen sulfide concentration in the vicinity of the inner wall surface of the side wall 2*d*, and the inner wall surfaces of the front wall 2*b* and the rear wall 2*c* are less likely to be corroded.

On the other hand, since the inner wall surface of the side wall 2*d* where the burner 4 is not installed is located far from the burner 4, the oxygen concentration is likely to be relatively lower and the hydrogen sulfide concentration is likely to be relatively higher in the vicinity of the inner wall surface of the side wall 2*d*. In the boiler 1 of the present embodiment, the ammonia injected from the ammonia injection port 2*f* is burned in the vicinity of the inner wall surface of the side wall 2*d*, and many OH radicals are generated in the vicinity of the inner wall surface of the side wall 2*d*. As a result, an oxidation reaction of hydrogen sulfide is promoted in the vicinity of the inner wall surface of the side wall 2*d*, and thus it is possible to suppress corrosion of the side wall 2*d* due to the hydrogen sulfide. That is, according to the boiler 1 of the present embodiment, it is possible to suppress corrosion of the wall part of the furnace 2 due to the hydrogen sulfide in a case of performing mixed-fuel combustion of the fuel containing the sulfur component and the ammonia fuel.

In addition, in the boiler 1 of the present embodiment, as the wall parts, the furnace 2 includes the front wall 2*b* where the burner is installed, the rear wall 2*c* where the burner 4 is installed and which is disposed to face the front wall 2*b*, and the side wall 2*d* that connects the front wall 2*b* and the rear wall 2*c* to each other and where the burner 4 is not installed, the ammonia injection ports 2*f* are provided on both the front wall 2*b* and the rear wall 2*c*, and the ammonia injection port 2*f* is disposed closer to the side wall 2*d* than the burner 4 in the horizontal direction. Therefore, it is possible to reliably form a region having the high concentration of OH radicals between the flame formed by the burner 4 and the side wall 2*d*, and it is possible to more reliably suppress the corrosion of the side wall 2*d*.

In addition, in the boiler 1 of the present embodiment, the ammonia injection port 2*f* injects the ammonia in the direction in which the burner 4 injects the fuel. Therefore, it is possible to prevent a flow of the ammonia injected from the ammonia injection port 2*f* from intersecting with a flow of the fuel injected from the burner 4, and it is possible to prevent the flow of the fuel injected from the burner 4 from being obstructed by the ammonia injected from the ammonia injection port 2*f*.

Second Embodiment

Next, a second embodiment of the present disclosure will be described. In the description of the present embodiment, the same elements as those of the first embodiment will be omitted or simplified in the description.

Figure 3:
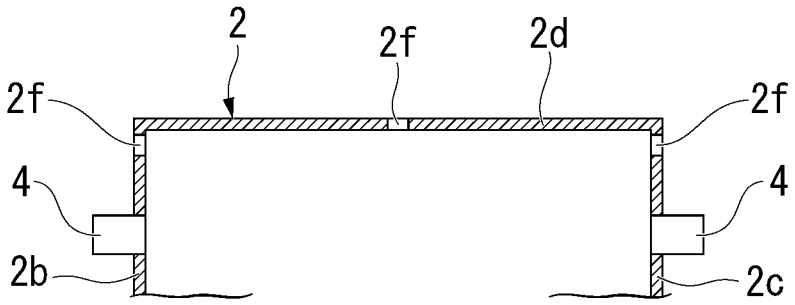
FIG. 3 is a plan sectional view including a side wall of a furnace included in a boiler according to a second embodiment of the present disclosure.

FIG. 3 is a plan sectional view including the side wall 2*d* of the furnace 2 included in a boiler of the present embodiment. As illustrated in FIG. 3, in the present embodiment, the ammonia injection port 2*f* is also installed on the side wall 2*d* in addition to the front wall 2*b* and the rear wall 2*c*. The ammonia injection port 2*f* installed on the side wall 2*d* is disposed in a substantially central part in the horizontal direction (forward-rearward direction) which connects the front wall 2*b* and the rear wall 2*c* to each other, and injects the ammonia along the inner wall surface of the side wall 2*d* at a gentle flow velocity.

The central part in the forward-rearward direction is located far from the ammonia injection ports 2*f* provided on the front wall 2*b* and the rear wall 2*c*. Therefore, there is a possibility that the ammonia injected from the ammonia injection ports 2*f* provided on the front wall 2*b* and the rear wall 2*c* may not reach the central part in the forward-rearward direction. As the ammonia injection port 2*f* is installed on the side wall 2*d* in the present embodiment, the ammonia can flow along a wider range of the inner wall surface of the side wall 2*d*, and it is possible to prevent the side wall 2*d* from being corroded in a wider range. Therefore, according to the boiler of the present embodiment, as the ammonia injection port 2*f* is provided on the side wall 2*d*, it is possible to prevent the side wall 2*d* from being corroded in a wider range.

Third Embodiment

Next, a third embodiment of the present disclosure will be described. In the description of the present embodiment, the same elements as those of the first embodiment will be omitted or simplified in the description.

Figure 4:
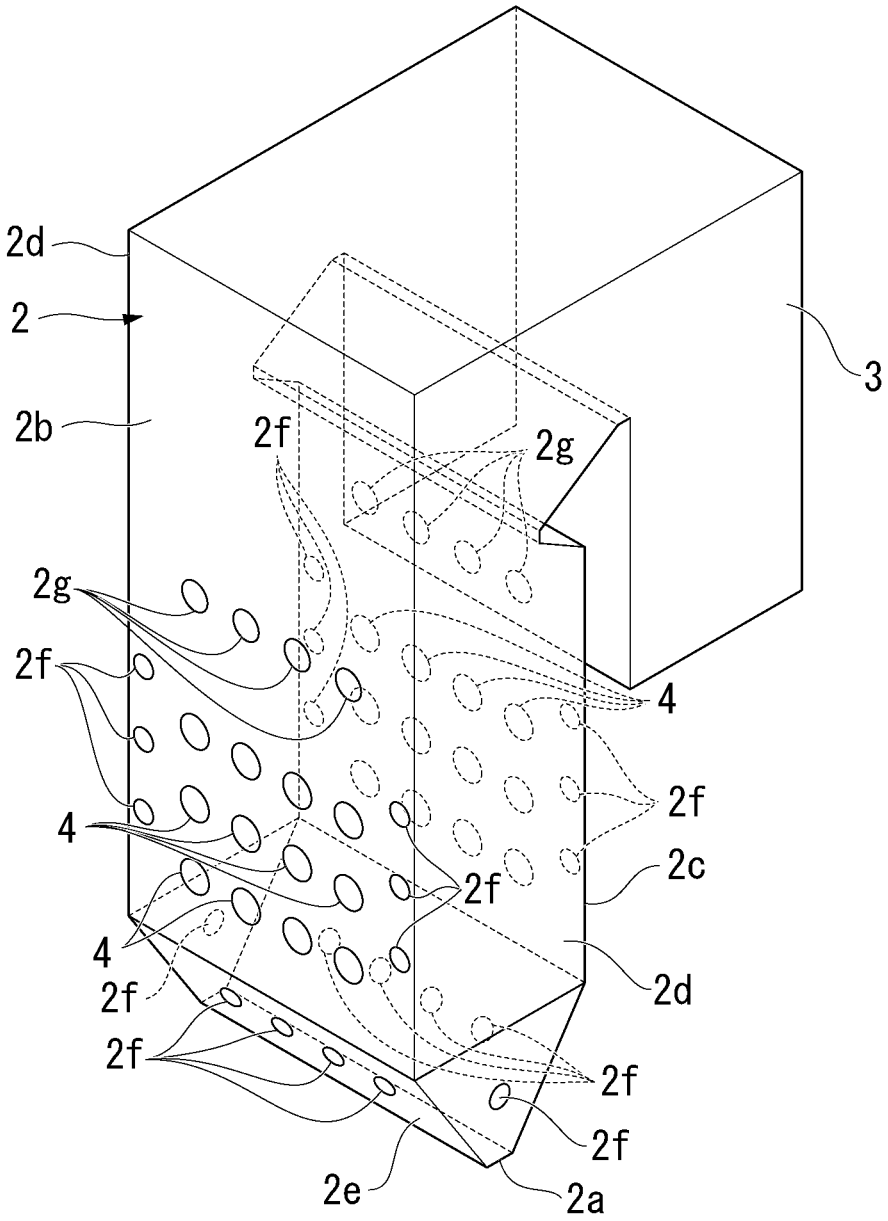
FIG. 4 is a schematic perspective view including a furnace for showing a disposition of a burner and an ammonia injection port which are included in a boiler according to a third embodiment of the present disclosure.

FIG. 4 is a schematic perspective view including the furnace 2 for showing a disposition of the burners 4 and the ammonia injection ports 2*f* in a boiler of the present embodiment. As illustrated in FIG. 4, in the present embodiment, a plurality of the ammonia injection ports 2*f* are provided on the hopper wall 2*e* where the burner 4 is not installed. The ammonia injection port 2*f* provided on the hopper wall 2*e* injects the ammonia along an inner wall surface of the hopper wall 2*e*.

According to the boiler of the present embodiment, the ammonia injected from the ammonia injection port 2*f* provided on the hopper wall 2*e* flows along the inner wall surface of the hopper wall 2*e*, and is burned in the vicinity of the inner wall surface of the hopper wall 2*e*, thereby forming a region having the high concentration of OH radicals in the vicinity of the inner wall surface of the hopper wall 2*e*. Therefore, the oxidation reaction of the hydrogen sulfide is promoted in the vicinity of the inner wall surface of the hopper wall 2*e*, and it is possible to suppress corrosion of the hopper wall 2*e*. As described above, according to the boiler of the present embodiment, it is possible to prevent not only the side wall 2*d* but also the hopper wall 2*e* from being corroded due to the hydrogen sulfide.

Hereinbefore, although embodiments of the present disclosure is described with reference to the attached drawings, the present disclosure is not limited to the above embodiments. The shape, the combination or the like of each component shown in the above embodiment is an example, and various modifications of a configuration based on a design request or the like can be adopted within the scope of the present disclosure.

For example, in the first embodiment and the third embodiment, as illustrated in FIGS. 2 and 4, a configuration is adopted in which another ammonia injection port 2*f* is not installed between the ammonia injection ports 2*f* disposed at the same height. However, the present disclosure is not limited thereto. For example, in a case where it is necessary to further improve corrosion resistance of the front wall 2*b* and the rear wall 2*c*, one or more ammonia injection ports 2*f* may be disposed between the ammonia injection ports 2*f* disposed at the same height.

In addition, in the above-described embodiment, an example has been described in which the present disclosure is applied to an opposed combustion boiler where the burners 4 are installed on the front wall 2*b* and the rear wall 2*c* of the furnace 2. However, without being limited thereto, the present disclosure may be applied to a circulation combustion type boiler as long as a boiler includes a furnace having a wall part where the burner is not installed.

In addition, in the above-described embodiment, a configuration is adopted in which the two-stage combustion air is supplied to the upper part of the furnace 2. However, the present disclosure may be applied to a boiler which does not supply the two-stage combustion air.

In addition, in the above-described embodiment, the boiler which performs mixed-fuel combustion of the pulverized coal and the ammonia as a fuel has been described. However, the present disclosure is not limited thereto. For example, a configuration may be adopted in which mixed-fuel combustion of natural gas and ammonia is performed, or a configuration may be adopted in which mixed-fuel combustion of heavy oil or light oil and ammonia is performed. That is, the present disclosure is applicable to a boiler which performs mixed-fuel combustion of a sulfur-containing fuel and ammonia.

The present disclosure is applicable to a boiler which performs mixed-fuel combustion of a fuel containing a sulfur component and an ammonia fuel.

What is claimed is:

1. A boiler which performs mixed-fuel combustion of a sulfur-containing fuel and ammonia, the boiler comprising:

a furnace having a plurality of wall parts;

a burner installed on at least one of the wall parts of the furnace and configured to inject into the furnace and burn the sulfur-containing fuel and a first portion of the ammonia; and an ammonia injection port that is configured to cause a second portion of the ammonia to flow and be burned along an inner wall surface of the wall part.

2. The boiler according to claim 1, wherein the wall parts of the furnace include a front wall on which the burner is installed, a rear wall on which the burner is installed, and which is disposed to face the front wall, and a side wall which connects the front wall and the rear wall to each other, and on which the burner is not installed, and the ammonia injection port is provided on at least one of the front wall and the rear wall, and disposed closer to the side wall than the burner in a horizontal direction.

3. The boiler according to claim 2, wherein the ammonia injection port is configured to inject the first portion of the ammonia in a direction in which the burner injects the sulfur-containing fuel and the second portion of the ammonia.

4. The boiler according to claim 2, wherein the ammonia injection port is further installed on the side wall, in addition to the at least one of the front wall and the rear wall.

5. The boiler according to claim 1, wherein the wall parts of the furnace include a hopper wall that is narrowed toward a discharge port through which ash is discharged outward, and the ammonia injection port is configured to cause the second portion of the ammonia to flow along an inner wall surface of the hopper wall.

* * * * *